United States Patent [19]

Poehlein

[11] 4,411,418

[45] Oct. 25, 1983

[54] DOCUMENT CORNER REGISTRATION

[75] Inventor: Raymond E. Poehlein, Fairport, N.Y.

[73] Assignee: Xerox Corporation, Stamford, Conn.

[21] Appl. No.: 348,128

[22] Filed: Feb. 12, 1982

[51] Int. Cl.[3] ..... B65H 9/00

[52] U.S. Cl. ..... 271/236; 271/251

[58] Field of Search ..... 271/225, 236, 239, 240, 271/248, 250, 251, 234, 238

[56] References Cited

U.S. PATENT DOCUMENTS

| | | | |
|---|---|---|---|
| 1,736,484 | 11/1929 | Broadmeyer | 271/251 |
| 1,973,749 | 9/1934 | Dawson | 271/52 |
| 2,190,413 | 2/1940 | Davidson | 271/49 |
| 2,190,416 | 2/1940 | Davidson | 271/251 |
| 2,190,417 | 2/1940 | Davidson, Jr. | 271/52 |
| 2,190,418 | 2/1940 | Davidson et al. | 271/52 |
| 2,300,625 | 11/1942 | Martin | 271/49 |
| 3,248,106 | 4/1966 | Fry | 271/52 |
| 3,550,933 | 12/1970 | Wilson | 271/52 |
| 3,630,518 | 12/1971 | Street | 271/49 |
| 3,703,626 | 11/1972 | Shanrock | 235/61.11 R |
| 3,709,484 | 1/1973 | Kistner | 271/49 |
| 3,908,986 | 9/1975 | Bleau | 271/227 |
| 4,014,539 | 3/1977 | Goodwin | 271/184 |
| 4,058,359 | 11/1977 | Urselmann | 355/109 |
| 4,072,305 | 2/1978 | Scheid et al. | 271/3 |
| 4,125,255 | 11/1978 | Stovall et al. | 271/251 |
| 4,179,117 | 12/1979 | Rhodes, Jr. | 271/251 |
| 4,203,588 | 5/1980 | Joosten | 271/246 |
| 4,266,762 | 5/1981 | Kramer et al. | 271/225 |
| 4,349,188 | 9/1982 | Young | 271/250 X |

FOREIGN PATENT DOCUMENTS

| | | | |
|---|---|---|---|
| 830344 | 2/1952 | Fed. Rep. of Germany | 271/251 |

OTHER PUBLICATIONS

C. D. Bleau, "Sheet-Aligning Mechanism", IBM Technical Disclosure Bulletin, vol. 16, No. 9, Feb. 1974, pp. 2921–2922.

K. A. Lennon & C. R. Spurlock, "Sheet Positioning Apparatus", IBM Technical Disclosure Bulletin, vol. 17, No. 10, Marcy 1975, p. 2971.

*Primary Examiner*—Richard A. Schacher

[57] ABSTRACT

Apparatus for driving a sheet into a corner registration with registration members defining two orthogonal registration lines, including a sphere mounted to overly and drivingly engage a sheet being so registered, said sphere being rotatable on variable axes and vertically and laterally movable relative to the sheet, including a drive engaging the sphere for rotatably driving said sphere and a sheet in an initial direction of rotation towards both orthogonal registration lines, but allowing changes in the direction of rotation of the sphere and lateral movement of the sphere relative to its retainer and different positions of engagement thereagainst in response to the different reaction forces on the sphere from a sheet being driven by said sphere, and including a normal force control system associated with the retainer for automatically varying the normal force between the sphere and the sheet being driven in response to the lateral movement of the sphere and the reaction force, this normal force control preferably being provided by selected non-uniform (higher frictional rolling resistance or differently sloped) sectors of the sphere retainer interior surface.

10 Claims, 6 Drawing Figures

DOCUMENT CORNER REGISTRATION

This invention relates to registering a flimsy sheet, such as an original document being copied, to both of two orthogonal axes, with improved registration reliability and sheet protection by an automatically controlled driving force in a simple apparatus.

Especially for the faster xerographic and other document copiers now in commercial use, it is increasingly desirable to provide a more automatic handling of the individual document sheets being copied, in order to more fully utilize the higher speed copying capabilities of these copiers. It is desirable to semi-automatically or automatically feed, register and copy document sheets of a variety or mixture of sizes, types, weights, materials, conditions and susceptibility to damage, yet with minimal document jamming, wear or damage by the document transporting and registration apparatus.

Even with slower copying rate copiers, it has become increasingly desirable to provide at least semi-automatic document handling, allowing an operator to "stream feed" originals into an input of the copier document handler, with the document handler doing the fine registration and feeding of the documents into and through the copying position, and then ejecting the documents automatically. However, in compact low cost copiers, the appropriate document handler must also be simple, low cost and compact.

Such a document handling system is preferably one which utilizes an existing or generally conventional copier optical imaging system, including the external transparent copying window (known as the platen) of the copier. It is also desirable that the document handling system be readily removable to alternatively allow the copier operator to conventionally manually place documents, including books, on the same copying platen. Thus, a light weight document handler is desirable.

A manual copying registration position is conventionally provided by a fixed raised registration edge or edges extending linearly along one or two sides of the platen, fixed to the copier body or fixed along one or two edges of the platen glass. It is often desirable for the automatic document handler to automatically register or maintain the document sheet at such an existing or conventional manual registration position.

One of the most important, and difficult to achieve, requirements for automatic or semi-automatic document handling is the accurate and reliable, but safe, transporting and registration of the original document relative to the proper registration position for copying. If the document is not properly registered, or slips after registration it will be misaligned relative to the copy. Simultaneous front (or rear) edge and orthogonal side edge document registration without bending or scuffing the document edges is particularly difficult, requiring driving of the document against both registration edges even though one of them is normally engaged before the other.

Conventionally the document is desirably automatically either center registered or corner registered (depending on the copier) by the document handler at a pre-set registration position relative to the copier platen, with two orthogonal edges of the document aligned with two orthogonal registration lines of the copier platen i.e. with the original document aligned with the copier optics and copy sheet registration system. This registration accuracy is desirably consistently within less than 1 millimeter. If the document is not properly registered, then undesirable dark borders and/or edge shadow images may appear on the ensuing copy, or information near an edge of the document may be lost, i.e. not copied onto the copy sheets.

In some document handlers it is preferable to preregister the document to a transport just before the document is transported over the copying window, particularly if the original document is being hand-fed in rather than automatically fed from a stack of documents. In other copying systems or modes, the document is additionally or alternatively registered overlying a full document sized (full frame) platen. Examples of both are cited herein. The present registration system is usable for either preregistration, or over-platen registration, or both, but is particularly suited for the latter, which is more difficult, since it must be done over the platen glass itself.

As shown in the cited art, document handling systems have been provided with various document transports to move the original document sheets over the copier platen and into and out of registration. Various combinations of such transports are known with various registration devices or systems. It is known in the art to register the original document for copying at the appropriate position relative to the transparent copying window in various ways. Typically the lead edge of the document sheet is registered to one axis by driving it against a gate or stop at one edge of the platen. This may comprise projecting aligned fingers, or roller nips, or a single vertical surface, against which that edge of the sheet is driven into abutment. An important function of such registration is to also deskew the moving original document, i.e., to properly align it with the registration line as well as to determine and control its registration position.

However, many such known recirculating document handlers drive a document onto the platen and register there only the lead or trail edge of the document, i.e. without precisely side (laterally) registering the document there. Side registration of the document in such systems may be only performed prior to moving the document onto the platen, and is generally merely that provided by the edge side guides of the document tray, which must be set to accommodate the maximum lateral dimensions of the largest documents in the set.

The present system can also provide side registering (laterally positioning) of each document on the platen i.e. proper corner registration alignment of each document on both orthogonal axes on the platen. The latter is also known per se, but with less desirable mechanisms. However, more typically, it is known to drive a document against (into abutment and alignment with) edge registration guides, stops or gates, using a rotating drive, before it is fed to be copied. For example U.S. Pat. No. 4,179,117 issued Dec. 18, 1979 to J. H. Rhodes (IBM) shows an angled drive member which drives a sheet toward side or edge registration as it is being fed to a platen. More particularly, U.S. Pat. No. 3,908,986 issued Sept. 30, 1975 to C. D. Bleau (IBM) has an intermittent such sheet alignment drive with a spherical ball providing a weight (normal force) on the opposite side of the sheet.

U.S. Pat. Nos. 4,050,688 issued Sept. 27, 1977 to K. K. Stange et al. and 4,130,274 issued Dec. 19, 1978 to K. K. Stange (Xerox) are of interest as exemplary of systems for pneumatically corner-registering a document to both edge and end guides directly on (over) a copying platen. Angled flapper wheel corner joggers are also known for over-platen corner registration as in pending U.S. application Ser. No. 240,428 filed Mar. 4, 1981 (D/79043) and art cited therein.

Also of interest here is showing prior corner document registration using in some way spheres or ball rollers, but otherwise distinguishable, are for example, U.S. Pat. Nos. 4,266,762 issued May 12, 1981 to W. E. Kramer et al. (Xerox Corporation) and 3,908,986 (supra). The latter is also disclosed in IBM Technical Disclosure Bulletins, Vol. 17, No. 10, p. 2971, March 1975, and Vol. 16, No. 9, February 1974.

Other U.S. Patents using spherical members in a system to align a sheet against a side alignment include 3,630,518, issued Dec. 28, 1971 to L. J. Street, which includes belt driven balls. Further spherical and/or angled roller systems are disclosed in U.S. Pat. Nos. 1,736,484; 1,973,749; 2,190,413; 2,190,416; 2,190,417; 2,190,418; 2,300,625; 3,248,106; 3,550,933; 3,630,518; 3,703,626; 3,709,484; 4,014,539; 4,072,305; 4,125,255; and 4,203,588. Lateral side-shifting of a document feeding roller is disclosed in U.S. Pat. No. 4,058,359 issued Nov. 15, 1977 to G. H. Urselmann.

All references cited herein, and the references cited therein, are also incorporated by reference herein for appropriate teachings of additional or alternative details, features, and/or technical background.

The present invention overcomes or reduces various of the above-discussed problems. The disclosed embodiments can provide positive corner document registration drive against two orthogonal registration stops or gates yet automatically limit the drive forces to prevent overdriving against either registration stop to protect against document damage. A preferred feature disclosed herein is to provide drive means engaging and rotatably driving a sphere in an initial direction of rotation towards both orthogonal registration lines, said sphere being adapted to drive a sheet with the driving force applied to said sphere by said drive means, said drive means engagement providing lateral movement of said sphere relative to said driving means and changes in the direction of rotation of said sphere relative to said initial direction of rotation, retainer means providing for limited variable lateral movement of said sphere thereagainst in response to the driving force from said drive means and to a reaction force on said sphere from a sheet being driven by said sphere, and normal force control means associated with said retainer means for varying the normal force between said sphere and a sheet being driven by said sphere in response to said lateral movement of said sphere and said reaction force.

Further desirable features which may be provided by the apparatus disclosed herein include embodiments in which said retainer means is non-uniform to provide a non-uniform normal force engagement with said sphere depending on the position of said engagement between said sphere and said retainer means, or in which said normal force control means comprises different coefficient of friction areas of said retainer means including a higher friction minor sector of said retainer means against which one side of said sphere is normally urged into engagement, said higher friction sector engagement providing a reduction in the normal force between the sphere and the sheet, said sphere being laterally shifted away from said higher friction sector towards a lower friction sector of said retainer means in response to the reaction force of a sheet registering along only one of said two registration lines to increase the normal force of the sphere against the sheet and to increase the sheet driving force in the direction along that one registration line towards the other said registration line; or embodiments in which at least one sector of said retainer means comprises a retaining surface differently angled from the vertical relative to other retaining surface sectors of said retainer means to provide a different normal force to said sphere when said sphere is driven against said differently angled sector, relative to engagement of said sphere with another said retaining surface sector of said retainer means; or in which said retainer means has an inwardly sloping said angled sector and an outwardly sloping said angled sector positioned so that said inwardly sloping sector is engaged by said sphere in response to the reaction force of a sheet registering along only one of said two registration lines to increase the normal force of the sphere against the sheet and to increase the sheet driving force in the direction along that one registration line towards the other said registration line; or in which said retainer means contains a laterally shiftable rotatable variable torque roller positioned to be rotatably engagable by said sphere to cause said roller to laterally shift to a position of lower torque resistance to rotation in response to the reaction force of a sheet registering along only one of said two registration lines to increase the normal force of the sphere against the sheet and to increase the sheet driving force in the direction along that one registration line towards the other said registration line; or in which said drive means frictionally engages the upper surface of said sphere, opposite from the surface of said sphere adapted to engage a sheet.

Further desirable features and advantages pertain to the specific apparatus and steps of operation whereby the above-mentioned and other features and advantages may be attained, including the examples described hereinbelow.

The invention will be better understood by reference to the following description of specific examples thereof, which include the following drawing figures (approximately to scale) wherein.

Figure 3:
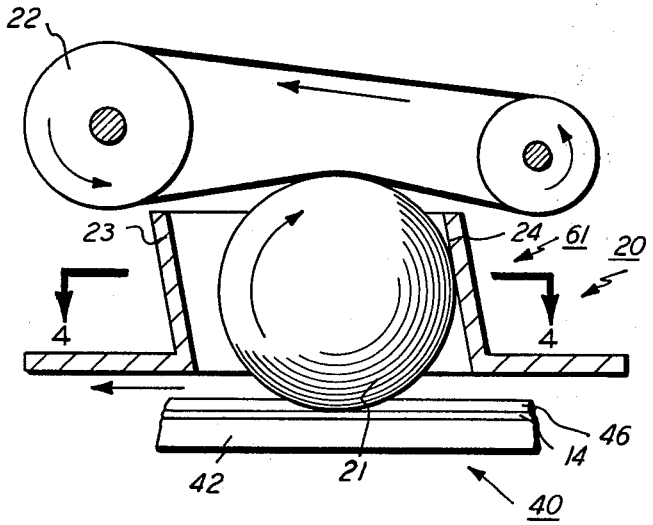
Figure 5:
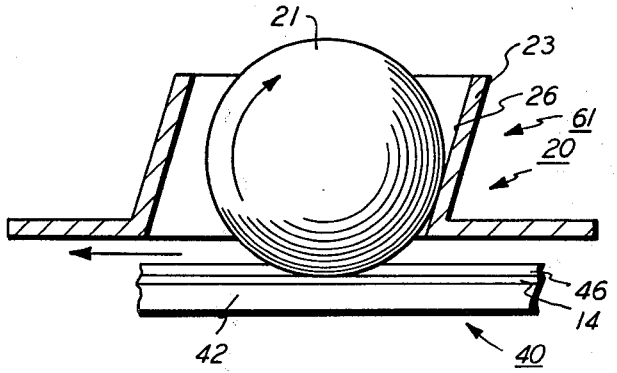
Figure 4:
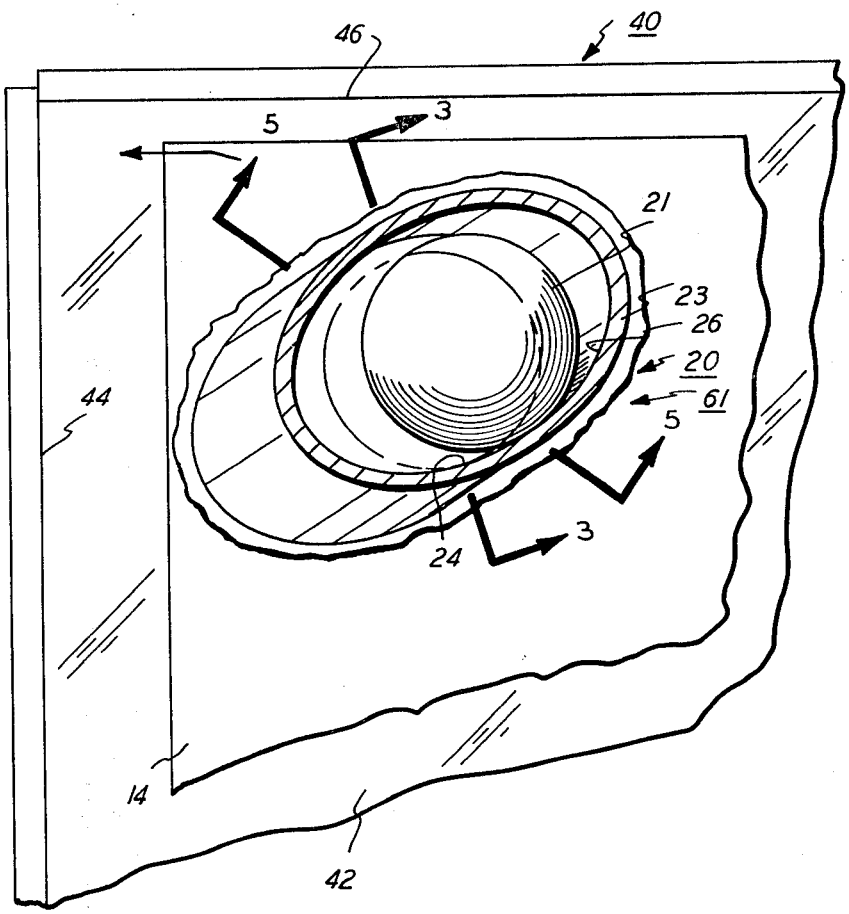
Figure 6:
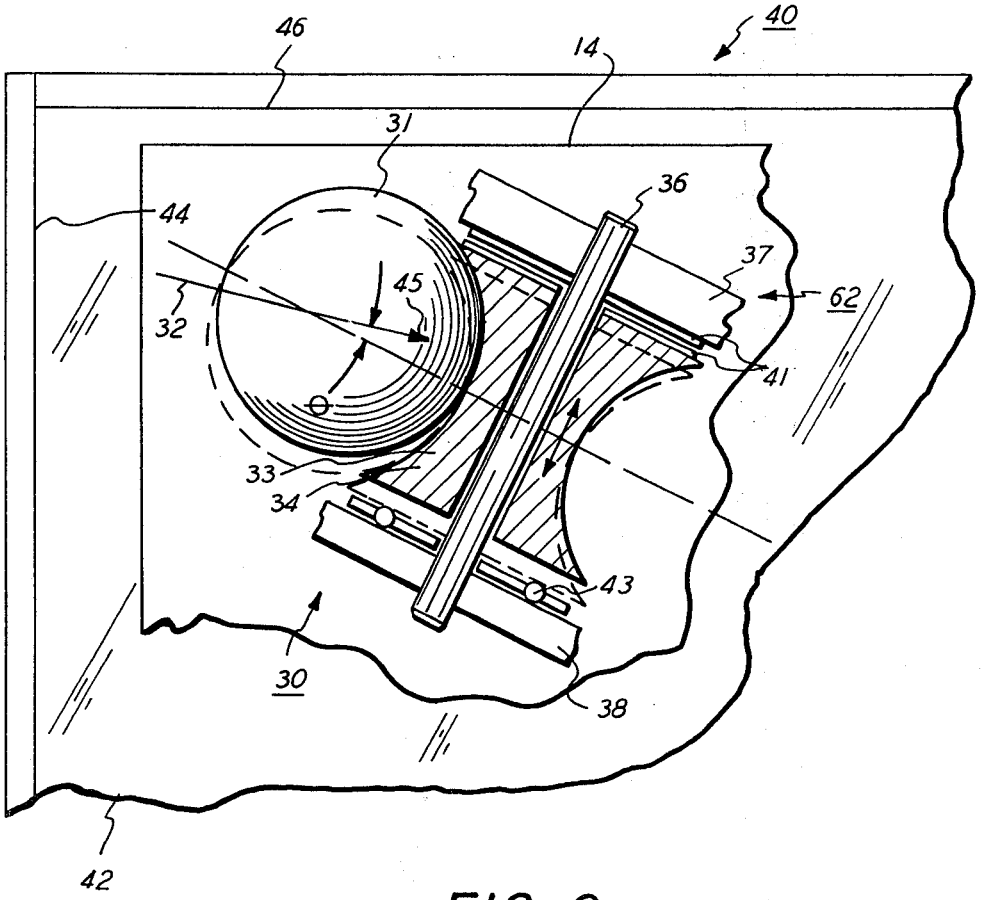

FIGS. 3–5 illustrate an alternative embodiment, of which FIGS. 3 and 5 are cross-sectional side views taken generally along the lines 3—3 and 5—5 of the FIG. 4 top view; and FIG. 6 is a top view, with the drive belt removed for clarity, of a third embodiment.

The three exemplary document registration system embodiments 10, 20, and 30, of FIGS. 1–2, 3–5 and 6, respectively, are all shown alternatively mounted to the same conventional copier 40 over the same conventional imaging station glass platen 42. The commonly illustrated example here of corner registration stop or alignment means comprises conventional fixed raised orthogonal registration stop surface members 44 and 46 extending respectively down along the downstream and side edges of the platen 42 to define the corner registration position of a document sheet on the platen. Each entire unit 10, 20 or 30, including its drive is preferably an integral part of an otherwise conventional platen cover unit 60, 61 or 62 conventionally pivotably mounted to overly the platen for document feeding, registration and copying but pivotably liftable away to allow alternative manual document placement and registration on the platen. As discussed above, these embodiments are merely exemplary. For example, the downstream or lead edge registration stop 44 may alternatively comprise retractable fingers or the like. Also the platen cover unit 60, 61 and 62 may be part of or connect to a document recirculator or automatic document stack feeder input. For clarity, certain conventional or non-relevant portions of the embodiments are not illustrated.

Each of the embodiments 10, 20 and 30, of FIGS. 1–2, 3–5 and 6, respectively comprise a similar sheet driving sphere or ball 11, 21 or 31, respectively driven by a similar belt driving means 12, 22 or 32. (The driving means 32 is only schematically illustrated by a movement arrow in FIG. 6.) Each driven ball 11, 21 or 31 is also controlled by a special retainer means 13, 23 or 33, respectively, differing between the embodiments 10, 20 and 30 as will be further described in detail herein. The retainer means provides a controlled variable normal force between the driven ball and the document sheet. As used herein, the term retainer means should be broadly contained to cover whatever members or surfaces are contacting the sphere in its lateral position in the functional manner described herein.

The common belt driving system 12, 22 and 32 may be any appropriate simple rotational driving system for the sphere 11, 21 or 31 respectively. Preferably here it engages the upper surface of the sphere with relatively high friction to provide a constant rotation of the sphere. The driving system here also provides a downward loading or normal force on the sphere. In fact here this is the primary force holding the sphere against the document sheet. The weight of the sphere may be relatively insignificant in proportion to this normal force from the belt pressure. A conventional high friction rubber belt, with one flight of the belt running over the top of the sphere, is illustrated. However it will also be appreciated that other suitable driving means may be utilized, such as a deformable rubber friction roller, providing only that the driving system allows lateral movement of the sphere relative to the driving system. This driving system itself may be very simple because it can operate uninterruptedly in only a single driving direction in the present registration system, i.e. it need not be pivotally mounted and may operate on a fixed axis. In the present system, variations in driving direction and force on the document sheet are provided primarily by the interaction between the sphere and the sphere retaining means, and do not require movement or interruption of the drive system.

It will be seen that a very simple and low cost document feeding and registration system is provided with any of these three, or other, alternative embodiments.

The general function and operation and the problems overcome by these embodiments will first be further generally discussed. When registering a document sheet into a corner on a platen glass, four different operations or phases of the registration cycle should be considered. The first phase is the movement of the document on the platen before it reaches either registration edge. The second phase is the movement of the document along one registration edge towards the other registration edge after it impacts the first edge. The third phase is after the document has been registered into the corner, i.e. abuts both registration edges and is stationary. The fourth phase is with no document present. The feeding and normal forces required or desired for these various phases are significantly different. Generally the highest drive forces and greatest change in driving direction are required during the second phase when the document is being driven (slid) along one registration edge. In contrast, a minimum, or no, sheet driving force is desired after the document reaches corner registration, i.e. abutment with both registration edge members. Most corner registrations systems, however, undesirably drive with a high force towards both edges in all said phases, even in the third phase after the document has already reached the corner. This can lead to document buckling, document damage, and other undesirable results. The alternative of lower driving forces can lead to misfeeding and misregistration, especially in the second phase.

The driven sphere system shown here has the potential to minimize many of these problems by automatically changing the magnitude and direction of the drive forces for the different phases in a desirable manner in response to the actual reaction forces from the driven document (or from the platen glass in the fourth phase).

By way of further background, it is well known that in general the maximum driving force available before slippage occurs between two surfaces is a function of the coefficient of friction times the normal force between the two surfaces. In the case of many of the above-noted prior art sphere systems that normal force is a constant force due soley to the weight of the sphere itself, which merely rests on the surface being driven.

In contrast in the present system the total normal force between the sphere and the document sheet (in this case a vertical downward force from the sphere) is variable in an automatically controlled manner. This correspondingly greatly changes the document sheet driving force (in this case a horizontal driving force) to provide automatically for the different operating modes or phases of operation.

There are a number of controllable design parameters in the disclosed systems. These include the various coefficients of friction between the surface of the spherical elements 11, 21 or 30 and the other surfaces which they engage.

First, there is the coefficient of friction between the sphere and its driving system. Here this is the frictional driving belt system 12, 22 or 32 engaging the upper surface of the sphere with a high coefficient of friction.

Secondly, the opposite or lower surface of the sphere either frictionally contacts the document sheet 14 being driven into registration, or the glass surface of the platen 42 if no document sheet is present thereunder. The coefficient of friction between the sphere 11, 21 or 31, which is typically an elastomer (relatively hard rubber) or the like, and the surface of the document sheet 14, which is typically paper, or the glass surface, is normally much less than that between the belt drive system 12, 22 or 32 and the sphere, so that any slippage will occur with the paper or glass rather than the sphere driving system.

Figure 1:
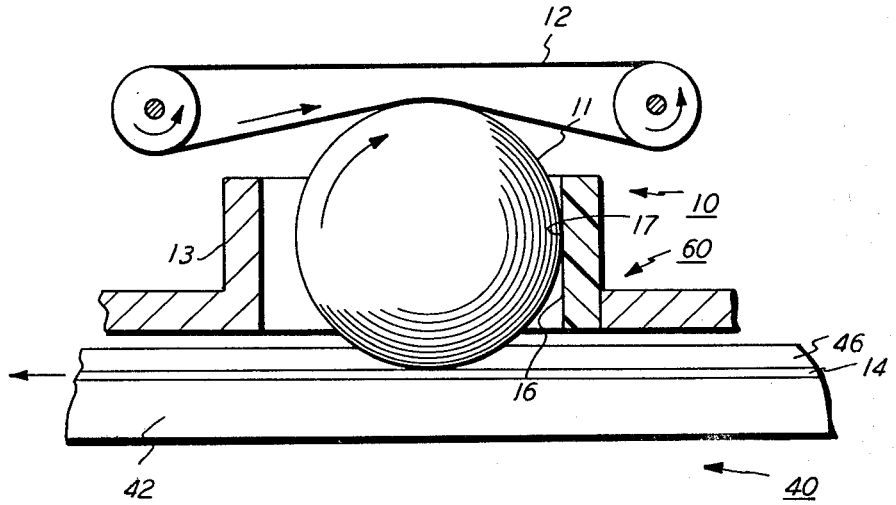
FIG. 1 is a cross-sectional side view of one embodiment of an exemplary document registration apparatus in accordance with the present invention on an exemplary copier platen (partially shown)
Figure 2:
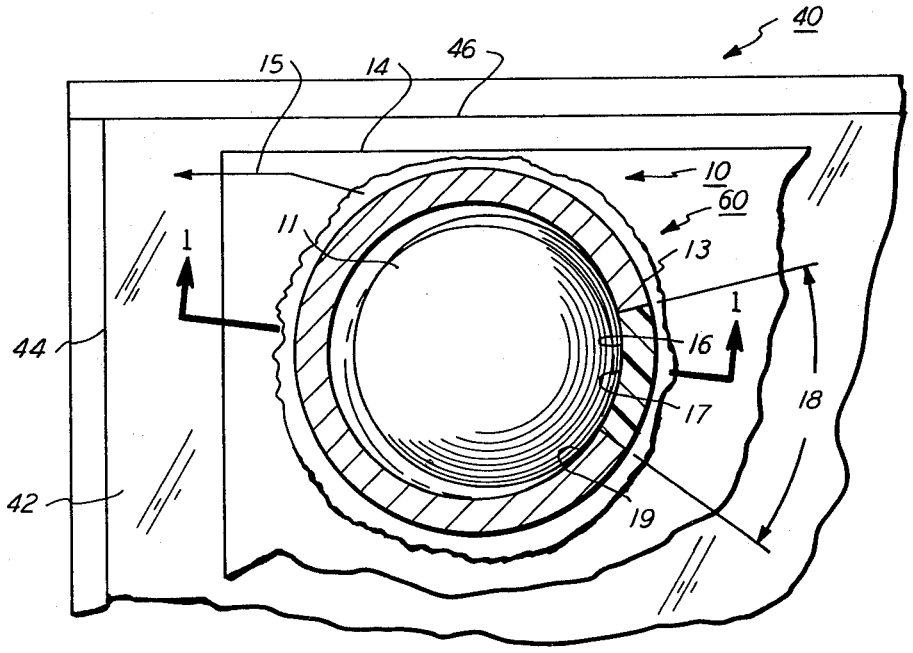
FIG. 2 is a top view of the embodiment of FIG. 1 with the drive belt removed for drawing clarity.

Finally, there is here the coefficient of friction and horizontal reaction force between the sphere 11, 21 or 31 and its retaining means 13, 23 or 33. In the embodiment of FIGS. 1–2 and 6, that coefficient of friction varies with the position of the sphere and is used to control the normal force between the sphere and the document sheet or platen glass i.e. in those embodiments the rotational resistance or drag force between the sphere and its retainer means is different for different portions or sectors of the retainer means in part because the coefficient of friction (or resistance to rotation) is different for different positions or points of contact between the sphere and its retainer means.

It is important to note in this regard that in all of the embodiments herein the sphere is provided with freedom of limited distance lateral movement within and relative to the sphere retainer means. The belt driving system for the sphere also provides such free lateral movement on both horizontal axes. Here this horizontal movement or repositioning of the sphere relative to the retainer means is provided by the horizontal reaction forces on the contacting bottom of the sphere. Those reaction forces are equal in magnitude and opposite in direction to the driving force of the sphere on the document sheet or platen glass which it is being rotated against.

An alternative variable which is utilized in the embodiment of FIGS. 3–5 is the angle from the vertical of the sphere contacting wall of the retainer means 23. In that embodiment, as will be described further herein, rather than varying the coefficient of friction between the sphere and the retainer means between the different points of contact, the contact angle of the retainer surface is varied for different positions or sectors of the retainer to provide different force vector affecting the total normal force between the sphere and its contacting sheet or platen glass.

During the time period when the document is being driven into registration, slippage must occur between the document sheet and the platen glass. For typical documents the coefficient of friction therebetween is low, e.g. approximately 0.3. During this time period (mode of operation) it is desirable to minimize slippage between the sphere and the document and to avoid "scrubbing" the top of the paper with the rotating sphere. The coefficient of friction between the sphere and the document is typically on the order of 1.4, for a typical document. The horizontal driving force on the document is a function of both this coefficient of friction and the total normal force between the sphere and the document. However once the document reaches both registrations edges, i.e. is cornered registered (and until the document is then removed) the document must stop, and therefore slippage must occur between the sphere and the document to avoid document damage. At this time it is desirable to minimize the "scrubbing" action of the sphere on the document. These apparatus do that by reduction of the normal force between shphere and document. To express it another way, an ideal document positioning system will drive the paper forward with a high horizontal force only in the desired direction and minimum slippage until both forward edges of the document are aligned with and are abutting both registrations edges, and thereafter reduce the driving force between the sphere and the document as much as possible. An alternative system would be to detect a completed registration with sheet position detectors and stop the drive member. However, that would require a much more complex and expensive apparatus and introduce reliability and maintenance problems. In contrast, the present system closely approaches the ideal drive system by greatly reducing the normal force, and therefor the driving force, between the sphere and the paper after corner registration without any need to detect registration, or stop and start the drive system, or even change the direction of driving of the drive system.

For all of the embodiments described herein, it should be noted that the sphere will make contact with the inside wall of its retainer means at only one point or location at a time. The one particular contact area portion is determined by the lateral position of the sphere, as discussed above. That lateral position here is determined by the initial direction in which the driving means supplies a driving force to the sphere and by the reaction force between the driven sphere and the member which it is drivingly engaging, normally the document sheet.

This reaction force on the sphere varies greatly in direction and in intensity depending on the resistance to movement encountered by the document sheet. When a document sheet strikes one of the two registration edges that sheet's resistance to further movement toward that same direction, i.e. along that one driving axis, is immediately greatly increased to become much higher than the resistance of the sheet to being driven along the other axis toward the other registration edge. However, the latter movement resistance force also then greatly increases compared to the initial driving resistance, due to the drag of the document sheet along the one said registration edge already engaged. These differences in reaction forces cause lateral shifting of the sphere relative to its retainer. That changes the contact point therebetween. This change or shift in the contact point is utilized to provide an increased change in a vertical reaction force on the sphere (between the sphere and the retainer) changing the total normal force and thereby changing the driving force between the sphere and the copy sheet.

The following discussion will be with particular reference initially to the embodiment of FIGS. 1 and 2. However, it will be appreciated that much of this discussion will also be applicable to the other two embodiments of FIGS. 3–5 and 6, with differences which will be discussed with reference to those embodiments.

The solid line position of the sphere 11 in both FIGS. 1 and 2 is the position of the sphere 11 in the operating mode when the document sheet 14 is being driven in but has not yet engaged either of the registration edge members 44 or 46. This will also be the position of the sphere in the mode after the sheet is driven into complete registration against both registration edges. This solid line position of the sphere 11 in FIGS. 1 and 2 is also the position of the sphere when there is no sheet under the sphere, i.e. when the sphere is slipping relative to bare platen glass. Note that in this solid line position the point of contact 17 between the sphere 11 and the retainer means 13 is at a frictional surface 16 thereof. This is a relatively high friction limited angular sector or segment 18, forming only an acute angle, of the total circumference of the interior of this sphere retainer 13. This high friction sensor 18 may be an insert of any suitable conventional frictional materal as shown, or alternatively a frictional tape or surface coating. It is contiguous with the rest of the sphere retainer interior surface, but with a relatively much higher coefficient of friction with the sphere, for example 0.7 as opposed to 0.1 for the adjacent areas of the retainer interior surface.

Still referring to the solid line sphere position in the embodiment of FIGS. 1 and 2,it may be seen that the horizontal resultant force with which the sphere 11 is driven into engagement with the frictional surface 16 is a function of the horizontal force in that general direction provided to the top of the sphere by the belt driving system 12 plus a force in that same direction provided to the bottom of the sphere by the reaction force between the sphere 11 and the sheet 14, i.e. the force resisting the driving of the sheet by the rotating sphere. If the sheet 14 is moving freely, i.e. slidingly freely over the platen glass with low friction, this reaction force is low and therefore the horizontal contact force between the sphere and the frictional surface 16 is low. Accordingly the rotation of the sphere against even the frictional surface 16 in this case will have little effect on the total normal force between the sphere and the copy sheet. That is, the normal force will be relatively high.

However, once the sheet 14 is resisted in its movement, as by engagement with one or both registration edges, the reaction force will immediately increase. This reaction force, in turn, directly increases the horizontal contact force between the sphere 11 and the retainer surface. This, in turn, increases the upward resultant reaction force on the sphere 11. This increase in upward resultant reaction force is especially large when the sphere is contacting high friction surface 16, i.e. when the document is registered against both registration edges or no document is under the sphere. In effect the sphere tends to "climb" up the retainer wall at the frictional surface 16 with an upward force which increases in proportion to the horizontal resultant force therebetween. This upwards force subtracts from the total downward normal force on the sphere. The higher the horizontal reaction force in this operating mode, the greater the reduction in the normal force between the sphere and the sheet, and the greater the reduction in the driving force on the paper or bare glass.

It has been determined that a very large difference in normal forces can be obtained from this system. For example, it has been calculated that the normal force between the sphere and the document sheet can be approximately 3 times higher during the time the sheet is being driven toward both registration edges than during the time after the sheet has been fully registered against both registration edges.

As noted, in the operating modes described above for the FIG. 1–2 embodiment, the sphere 11 is in its illustrated solid line position against the high friction sector. In contrast, the illustrated dashed line position of the sphere 11 in FIG. 2 is the operational mode in which the sphere has been laterally shifted away from contact 17 with the high friction sector 18 to a different contact 19 with a low friction sector of the retainer means. This will occur by a document sheet having reached registration with one edge 46 and resisting being driven further in that direction. In this mode the normal force is increased rather than decreased. That is, in this dashed-line contacting postion 19, there is no significant vertical reaction force component affecting the normal force. The sphere is not attempting to "climb" a high frictional surface. Rather it is rolling with little resistance against a low friction surface. Accordingly, the total normal force can be nearly equal to the full normal force being applied to the sphere, regardless of the reaction force of the sheet being driven. This greatly increases the available driving force on the sheet to drive the sheet along the first registration edge toward the second registration edge. This can be, for example, nearly twice the driving force which was being previously applied to the sheet before it reached either registration edge.

Then, as previously described, with this system, this high driving force in the dashed-line position of the sphere as the sheet is being driven along one registration edge toward the other can be almost immediately dropped to approximately 1/6th of that prior driving force by an automatic reduction of approximately 6 to 1 in the normal force once registration is achieved and the sphere has shifted automatically back into a high reaction force contact with the high friction sector of the retainer means. This automatic shifting of the lateral position of the sphere once the second edge of the sheet has reached abutment with the second registration edge occurs rapidly because it is unrestricted by the driving system for the sphere or by the retainer means, and there is little inertial resistance to this movement with a relatively low mass sphere. Thus, the shift in position of the sphere and consequent reduction in normal force and driving force between the sphere and the sheet can occur extremely rapidly once resistance of the sheet to any further movement along either diagonal axis is achieved, i.e. once corner registration is achieved.

Thus, to summarize the above, there has been disclosed a system which automatically provides very desirable variations of the driving force on the sheet. The sheet is driven with a relatively high force toward both registration axes, is then driven with an even higher force as the document is slid along one registration edge toward the other, and then there is a greatly reduced driving force on the document sheet after it is in full registration against both registration edges. This is obtained without changing either the drive means or the externally applied normal force on the sphere. It is obtained here soley by automatically controlling the total effective normal force with changes in the reaction forces and their effect on the point of contact, and resultant vertical reaction force, between the sphere and its retainer means. In particular, in the embodiment of FIGS. 1 and 2 this is assisted by differences in the coefficient of friction between the sphere and the retainer means in different contacting portions thereof.

To express it another way, in the operating mode when the document is abutting (only) one registration edge the reaction force vector between the sphere and the document is at a high angle substantially perpendicular the contacted registration edge. That shifts the sphere laterally within its retainer in the direction away from that one registration edge. Thus, in the embodiment of FIG. 2, where it is assumed that the document sheet has contacted the side registration edge member 46 first, it may be seen that the sphere 11 has shifted directly away from the side edge 46 to the illustrated dashed-line position due to that sheet engagement with edge 46. If the other registration member 44 had been contacted first, the sphere would have shifted to a different position, i.e. a different retainer contact point opposite from the registration member 44 instead of opposite from the member 46. It is desirable for these alternative sphere position contact points with the retainer to be at a low friction portion thereof rather than in the high friction sector, for the reasons described herein.

The sheet movement arrow 15 in FIG. 2 illustrates the movement of the document sheet 14 first generally toward both registration members i.e. generally towards the corner, and then in this case along the side registration member 46 into full registration. This movement transition is illustrated by the change in direction of the arrow 15.

Note that the initial direction of rotation of the sphere 11 and therefore the initial driving direction of the document therewith is also controlled by the direction of movement of the belt driving system 12. This may be preset at more of an angle to one registration side than the other, rather than aimed directly into the corner, to favor, as here, normal initial contact of the document sheet with one registration member 46 first rather than the other registration member 44. In this case, there will normally be only two different sphere contact points 17 and 19 with the retainer 13 during operation, as illustrated in FIG. 2. Thus, the frictional sector 16 may be larger, if desired.

Note that since the sphere 11 is freely rotating, that not only its contact point with the retainer but also its direction of rotation will change, depending on the nature of the forces acting on it. That is, the sphere 11 does not necessarily rotate in the same direction of motion as the belt driving system 12. This is particularly true during the mode in which the document sheet is being driven along one registration member toward the other. In that mode the direction of the rotation of the sphere will be parallel the first registration surface contacted.

Turning now to the embodiment of FIG. 6, the principle of operation thereof is very similar to the embodiment of FIGS. 1 and 2. In the FIG. 6 embodiment a part of the retainer means 33 comprises a contoured roller 34 rotatably mounted on a shaft 36. The roller 34 is also slightly axially shiftable or slideable along said shaft 36 between stationary end plates 37 and 38. The end plate 37 is adapted to provide a frictional contact with that end of the roller 34 by means of frictional pads or discs 41. In contrast, the opposite end of the roller 34 is adapted to make a low friction engagement through a conventional thrust bearing 43 or other low friction surface member with the opposite stationary end plate 38. Thus, depending on the axial shifting of the roller 34 along the shaft 36 towards one end plate or the other, the roller 34 will rotate either with low friction or high friction resistance to rotation. Furthermore, the amount or degree of force by which the roller 34 is thrust against the frictional discs 41 at that end plate 37 will determine the degree or magnitude of frictional resistance to rotation.

It may be seen that the above-described roller 34 unit of FIG. 6 comprises a key functional portion of the retainer means 33 for this embodiment. The shift in lateral position of the sphere 31 during the different modes of operation due to the different reaction forces from the driven document sheet here not only causes movement of the contact point between the sphere 31 and the roller 34 but also causes movement of the roller 34 along the shaft 36 corresponding to that shift in position of the sphere 31. Similarly to the embodiment of FIGS. 1 and 2, the amount of resistance to rotation of the roller 34 translates into an equivalent reduction in the normal force of the sphere 31 against the document sheet.

Note that the surface of the roller 34 must provide a relatively high coefficient of friction with the sphere 31 in order to be effective here. Also the surface of roller 34 is a surface of revolution with a radius which increases from its center towards its ends so as to form a curved contact line thereon in the axial direction which has a larger radius than that of the sphere 31.

An advantage of the embodiment of FIG. 6 is that when the sphere 31 is shifted to its dashed-line position, which will occur as the sheet is being driven along the side registration member 46 toward the other registration surface 44, that the full (maximum) normal force will be applied between the sphere 31 and the document sheet. This is because in this mode the roller 34 shifts on the shaft 36 into engagement with the low friction bearing 43. Therefore, in that mode there is little resistance to the rotation of the sphere 31. There is free rolling contact between the sphere 31 and the roller 34. Thus there is little vertical reaction force on the sphere 31 to subtract from the applied normal force.

In FIG. 6 the arrow 45 represents the direction in which the belt driving system 32 is rotating at its contact with sphere 31. As shown, this is at a slight angle $\theta$ to the center line perpendicular of the roller 34 on shaft 36, as illustrated by the dashed line intersecting with arrow 45 to initially bias the sphere towards its solid line position.

It will be appreciated that various other modifications of the embodiment of FIG. 6 may be envisioned, such as a combination of a simple free rolling cylindrical roller at right angles to a fixed planar frictional wall, forming a V therewith, in which that roller provides only the low friction point of contact engagement function. Other alternatives include two rollers with two different rolling resistances or various combinations with the other embodiments described herein.

Referring now to the embodiments of FIGS. 3–5, the operation of this embodiment differs in that instead of using different frictional areas of the retaining member to provide different normal forces for the different modes of operation, here the different normal forces are provided by different sloping sectors of the retainer means, i.e. with different angles from the vertical. However, it will be appreciated that the features of the different embodiments may be combined, i.e. that the embodiment of FIGS. 1 and 2 may also have sloping retainer walls or that the embodiment of FIGS. 3–5 may have relatively higher friction surface areas thereof as well as angled surfaces.

When the sphere 21 of the embodiments of 3–5 is driven by the reaction force of the document sheet into contact with an inwardly sloping sector 24 section of the retainer means as in FIG. 3, a downward or increasing normal force reaction vector will be provided on the sphere 21 to increase the total normal force. In contrast in FIG. 5, where the sphere 21 is laterally shifted into engagement with a different, outwardly sloping, sector 26 of the retainer means, the normal force between the sphere 21 and the document will be decreased in proportion to the reaction force between the sphere 21 and the sector 26 and the angle or slope of surface 26 away from the vertical.

Since the retainer means 23 may have the same coefficient of friction throughout its entire interior surface in the embodiment of FIGS. 3–5, it may be a unitary member of the same material. It may be cast from plastic, metal or any other suitable relatively low friction retaining member material.

Note that in both the sectors 24 and 26 of FIGS. 3 and 5, respectively, the slope of the retainer wall is such as to not restrict the free lateral movement of the sphere 21. That is, the total area of the internal opening of the retaining means 23 is greater in all dimensions than the diameter of the sphere 21 at any possible point of contact therewith. Furthermore, as in the other embodiments, the transitions between the inward sloping and outward sloping sectors 24 and 26 of the retainer means 23 are preferably smooth and continuous, so as to allow the sphere 21 to freely roll along the wall of the retainer means 23 from a one sector to the other sector without interruption or force discontinuities.

Functionally reviewing the operation of the embodiment of FIGS. 3–5, in a first mode of operation (before there is any document paper under the sphere 21) the system will automatically reduce the normal force between the sphere and the platen glass to a low level. This is because the reaction force between the rotating sphere and the platen glass will maintain the contact between the sphere 21 and the retainer means 23 at a contact point on the outwardly sloping sector 26 as shown in FIG. 5 and as shown by the solid line sphere position in FIG. 4. The relatively high driving force due to the relatively high friction between the sphere and the platen glass will create a correspondingly relatively high resultant horizontal force between the sphere and the outward sloping sector 26 wall. That generates a corresponding upward vertical reaction force vector on the sphere from the upward slope of the sector wall 26, which thereby greatly reduces the normal force between the sphere and the platen.

In the second mode of operation of the embodiment of FIGS. 3–5, where the paper is being driven across the platen but before it reaches either registration edge, a normal force will be provided between the sphere 21 and the document sheet, higher than in the prior mode. The contact point between the sphere and the retaining wall will still occur as in FIG. 5 in this mode but there is a lower drag force and therefore a lower horizontal reaction force, because of lower friction between the paper and the platen. Therefore there is a lower upward resultant force (lower counter-normal force) between the sphere and the retainer wall 26.

In the third mode of operation, where the document is already engaged by the side registration member 46 and is being driven therealong toward the other registration member 44, the sphere 21 position is laterally shifted within the retainer means 23 to the sector 24 as in FIG. 3. This is due to the reaction force feedback from the registration edge through the paper back to the bottom of the sphere. Also there is a high drive force reaction. Thus there is a high horizontal resultant force between the sphere 21 and the inwardly sloping surface sector 24 of the retainer means. This, in turn, provides a greatly increased (high) downward force vector resultant on the sphere 21 to increase its normal force on the document, to increase the horizontal driving force on the document in this mode.

Once the document sheet reaches corner registration with both registration members, the sphere 21 will shift back to its initial position as in FIG. 5. The high reaction force (due to the movement of the sheet being stopped by both registration members) on the sphere 21 as it attempts to drive the document further immediately causes a high horizontal force to occur between the sphere 21 and the outwardly sloping wall 26, immediately greatly reducing the normal force between the sphere and the document sheet, thus allowing relatively free slippage therebetween. Thus, once corner registration is achieved, the driving force of the sphere on the document sheet is automatically greatly reduced, eliminating the danger of overdriving the document sheet and crumpling or damaging its edges against the registration stop members, as well as reducing problems with scuffing of the document surface by the rotating sphere 21. Note that this desirable effect may be increased even further by providing a higher friction surface at the outwardly sloping sector 26, although this is not necessary.

It may be seen that the above-described embodiments, and others, provide a uniquely automatic control of the driving forces on the document sheet during the entire process (all steps) of registering the document. It will also be appreciated that the embodiments described herein are merely exemplary and that other variations, modifications, refinements, or alternative embodiments may be provided by those skilled in the art from this teaching. They are intended to be encompassed by the following claims.

I claim:

1. In an apparatus for driving a sheet into a corner registration with registration means defining two orthognal registration lines, including a sphere mounted to overly and engage a sheet being so registered, said sphere being rotatable on variable axes and vertically movable relative to the sheet, the improvement comprising:

drive means engaging said sphere for rotatably driving said sphere in an initial direction of rotation towards both said orthogonal registration lines, said sphere being adapted to drive a sheet with the driving force applied to said sphere by said drive means, said drive means engagement providing lateral movement of said sphere relative to said driving means and changes in the direction of rotation of said sphere relative to said initial direction of rotation, retainer means providing for limited variable lateral movement of said sphere thereagainst in response to the driving force from said drive means and to a reaction force on said sphere from a sheet being driven by said sphere, and normal force control means associated with said retainer means for varying the normal force between said sphere and a sheet being driven by said sphere in response to said lateral movement of said sphere and said reaction force.

2. The apparatus of claim 1 in which said retainer means is non-uniform to provide a non-uniform normal force engagement with said sphere depending on the position of said engagement between said sphere and said retainer means.

3. The apparatus of claim 1 in which said normal force control means comprises different coefficient of friction areas of said retainer means including a higher friction minor sector of said retainer means against which one side of said sphere is normally urged into engagement, said higher friction sector engagement providing a reduction in the normal force between the sphere and the sheet, said sphere being laterally shifted away from said higher friction sector towards a lower friction sector of said retainer means in response to the reaction force of a sheet registering along only one of said two registration lines to increase the normal force of the sphere against the sheet and to increase the sheet driving force in the direction along that one registration line towards the other said registration line.

4. The apparatus of claim 1 in which at least one sector of said retainer means comprises a retaining surface differently angled from the vertical relative to other retaining surface sectors of said retainer means, to provide a different normal force to said sphere when said sphere is driven against said differently angled sector, relative to engagement of said sphere with another said retaining surface vector of said retainer means.

5. The apparatus of claim 4 in which said retainer means has an inwardly sloping said angled sector and an outwardly sloping said angled sector positioned so that said inwardly sloping sector is engaged by said sphere in response to the reaction force of a sheet registering along only one of said two registration lines to increase the normal force of the sphere against the sheet and to increase the sheet driving force in the direction along that one registration line towards the other said registration line.

6. The apparatus of claim 1 in which said retainer means contains a laterally shiftable rotatable variable torque roller positioned to be rotatably engagable by said sphere to cause said roller to laterally shift to a position of lower torque resistance to rotation in response to the reaction force of a sheet registering along only one of said two registration lines to increase the normal force of the sphere against the sheet and to increase the sheet driving force in the direction along that one registration line towards the other said registration line.

7. The apparatus of claims 1, 2, 3, 4, 5 or 6 in which said drive means frictionally engages the upper surface of said sphere, opposite from the surface of said sphere adapted to engage a sheet.

8. The apparatus of claims 1, 2, 3, 4, 5 or 6 in which said sphere, said drive means, said retainer means and said normal force means are all mounted in a platen cover unit removably overlying the transparent copying platen of a copier.

9. The apparatus of claims 1, 2, 3, 4, 5 or 6 in which said drive means has a fixed position and fixed direction of rotation in said initial direction of rotation.

10. The apparatus of claims 1, 2, 3, 4, 5 or 6 in which said drive means frictionally engages the upper surface of said sphere, opposite from the surface of said sphere adapted to engage a sheet;

said sphere, said drive means, said retainer means and said normal force means are all mounted in a platen cover unit removably overlying the transparent copying platen of a copier; and said drive means has a fixed position and fixed direction of rotation in said initial direction of rotation.

* * * * *